US006345579B1

(12) United States Patent
Zaturensky

(10) Patent No.: US 6,345,579 B1
(45) Date of Patent: Feb. 12, 2002

(54) REMOVABLE WORK SURFACE DEFINING DEVICE

(75) Inventor: Val Zaturensky, Denver, CO (US)

(73) Assignee: Engineered Data Products, Inc., Broomfield, CO (US)

( * ) Notice: Subject to any disclaimer, the term of this patent is extended or adjusted under 35 U.S.C. 154(b) by 0 days.

(21) Appl. No.: 09/625,601

(22) Filed: Jul. 26, 2000

(51) Int. Cl.[7] ..... A47B 5/00

(52) U.S. Cl. ..... 108/152; 108/108; 248/250

(58) Field of Search ..... 108/108, 152, 108/137; 248/235, 250–429, 241, 242

(56) References Cited

U.S. PATENT DOCUMENTS

| | | | | | |
|---|---|---|---|---|---|
| 4,103,855 | A | * | 8/1978 | Grosse | 108/108 X |
| 4,378,925 | A | * | 4/1983 | Griffin | 108/108 X |
| 4,660,477 | A | * | 4/1987 | Kotering et al. | 108/108 |
| 5,297,486 | A | * | 3/1994 | Herrmann et al. | 108/108 |
| 5,406,894 | A | * | 4/1995 | Herrmann et al. | 108/108 |
| 5,452,875 | A | * | 9/1995 | Kern | 108/108 X |
| 6,019,331 | A | * | 2/2000 | Hoogland et al. | 108/108 X |

* cited by examiner

*Primary Examiner*—Jose V. Chen

(74) *Attorney, Agent, or Firm*—Flanagan & Flanagan; John R. Flanagan

(57) ABSTRACT

A removable work surface defining device includes a pair of rigid support members attachable to a support structure, a platform defining a work surface surrounded by spaced apart opposite front and rear edge portions and spaced apart opposite side edge portions extending between the front and rear edge portions, and a pair of quick release locking mechanisms each for releasably attaching the platform at a respective one of the opposite side edge portions thereof upon an adjacent respective one of the rigid support members. Each of the quick release locking mechanisms includes first and second sets of elements, a locking latch and a catch. The first and second sets of elements are disposed on respective ones of the rigid support members and adjacent respective ones of the opposite side edge portions of the platform for undergoing relative movement between released and interengaged positions with one another upon movement of the platform between first and second positions relative to the rigid support members. The catches are provided on the respective ones of the rigid support members. The locking latches are mounted on the respective ones of the opposite side edge portions of the platform and movable relative to the platform between released and latched relationships with the catches on the respective ones of the rigid support members to thereby permit and block subsequent movement of the platform between the first and second positions relative to the rigid support members and the first and second sets of elements between the released and interengaged positions relative to each other.

16 Claims, 3 Drawing Sheets

REMOVABLE WORK SURFACE DEFINING DEVICE

BACKGROUND OF THE INVENTION

1. Field of the Invention

The present invention generally relates to office equipment such as computer workstations and media storage cabinets and, more particularly, is concerned with a removable work surface defining device for such office equipment.

2. Description of the Prior Art

Office equipment such as media storage cabinets are typically found in environments that employ high speed information storage, processing and retrieval machines. This type of office equipment typically does not provide extra space for work surfaces which are needed for office workers to carryout various documentation tasks associated with the management of information. The provision of a work surface defining device that could be accommodated at a variety of locations on such office equipment where a work surface might be needed by office workers would be desirable and would enhance the overall utility of such office equipment.

Consequently, a need exists for a work surface defining device which will provide a solution to the aforementioned problem in the prior art without introducing any new problems in place thereof.

SUMMARY OF THE INVENTION

The present invention provides a removable work surface defining device designed to satisfy the aforementioned need. The work surface defining device of the present invention can be readily and easily installed at and removed from various locations on wall portions of office equipment, such as media storage cabinets and the like, which normally do not provide extra space for work surfaces.

Accordingly, the present invention is directed to a work surface defining device which comprises a pair of rigid support members attachable to a support structure, a platform defining a work surface surrounded by spaced apart opposite front and rear edge portions and spaced apart opposite side edge portions extending between the front and rear edge portions, and a pair of quick release locking mechanisms each for releasably attaching the work surface defining platform at a respective one of the opposite side edge portions thereof upon an adjacent respective one of the rigid support members. Each of the quick release locking mechanisms includes first and second sets of interengaging elements, a locking latch and a catch. The first and second sets of interengaging elements of each quick release locking mechanism are disposed on the respective one of the rigid support members and adjacent respective one of the opposite side edge portions of the platform for undergoing relative movement between released and interengaged positions with one another upon movement of the platform between first and second positions relative to the rigid support members. The catch of each quick release locking mechanism is provided on the corresponding respective one of the rigid support members. The locking latch of each quick release locking mechanism is mounted on the respective one of the opposite side edge portions of the platform and movable relative to the platform between released and latched relationships with the catch on the corresponding respective one of the rigid support members to thereby permit and block subsequent movement of the platform between the first and second positions relative to the rigid support members and the first and second sets of interengaging elements between the released and interengaged positions relative to each other.

More particularly, the rigid support members each having a rear portion attachable to the support structure and an upper portion extending forwardly from the rear portion. The platform further has a bottom and a top defining the work surface. The quick release locking mechanisms are disposed on the bottom of the platform at the respective opposite side edge portions thereof and on the upper portions of the rigid support members and are adapted to releasably attach the platform at the bottom and respective opposite side edge portions thereof upon the upper portions of the respective rigid support members. The quick release locking mechanisms are substantially identical to one another.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
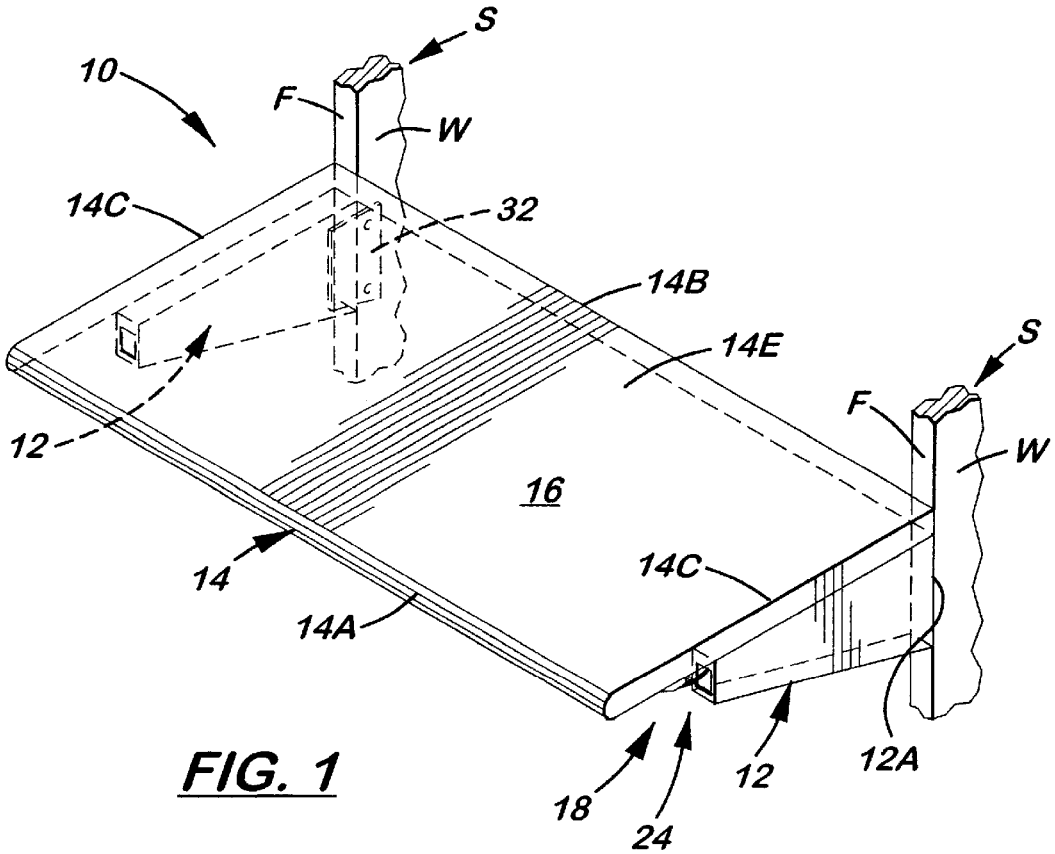
FIG. 1 is a top perspective view of a removable work surface defining device of the present invention.
Figure 2:
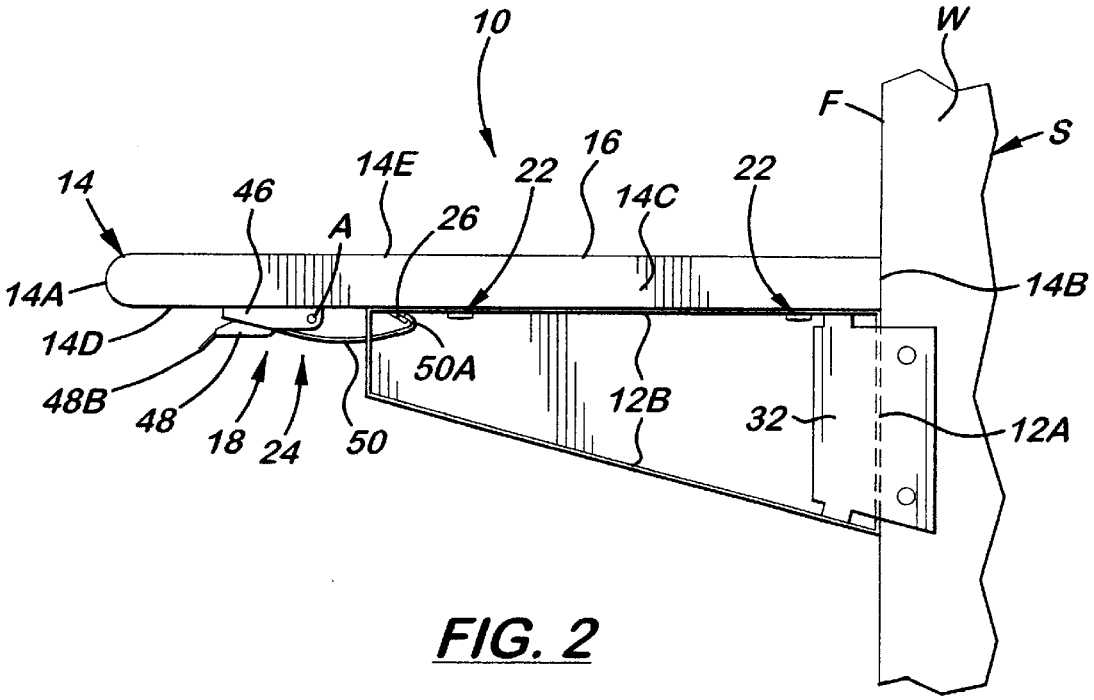
FIG. 2 is a side elevational view of the work surface defining device.
Figure 3:
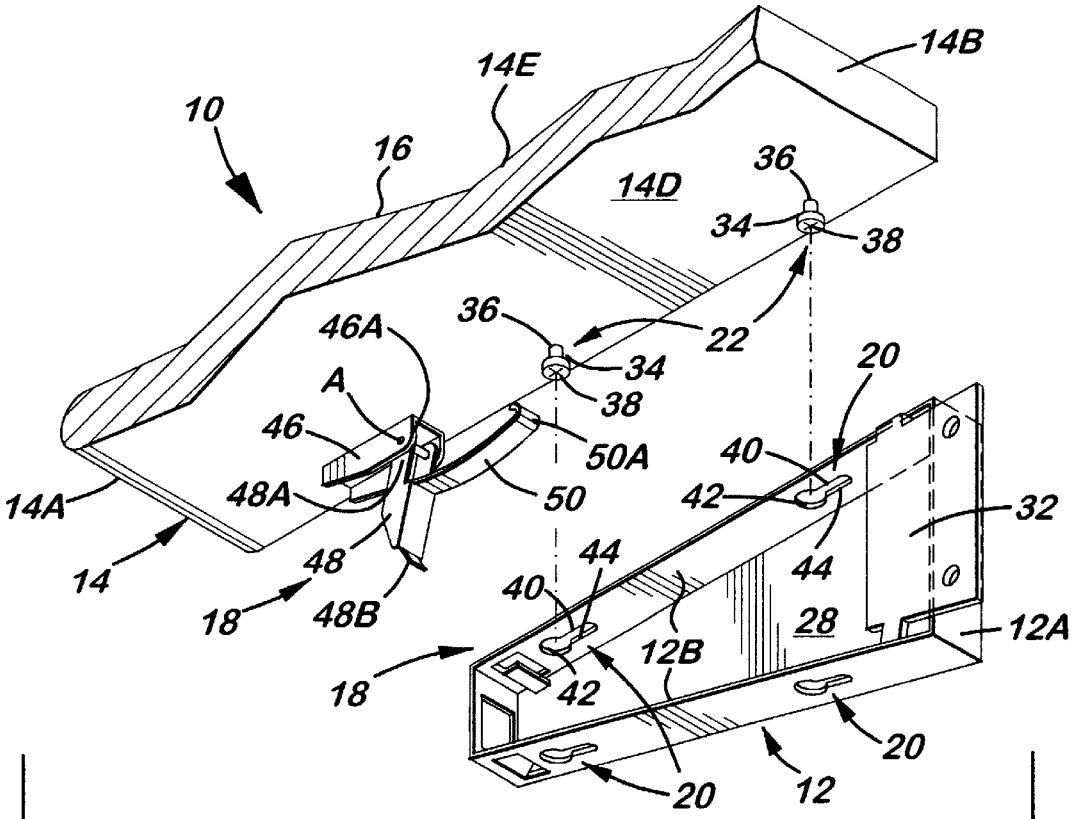
FIG. 3 is a fragmentary bottom perspective exploded view of some components of the work surface defining device before being assembled.
Figure 5:
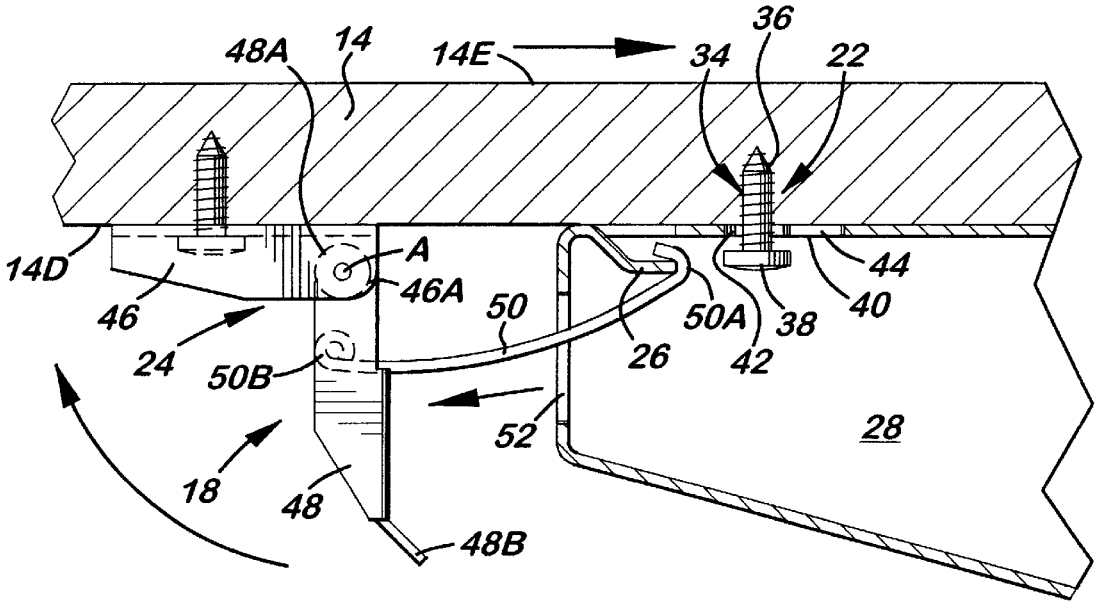
FIG. 5 is an enlarged fragmentary detailed view showing the components of the work surface defining device in the process so being assembled.
Figure 6:
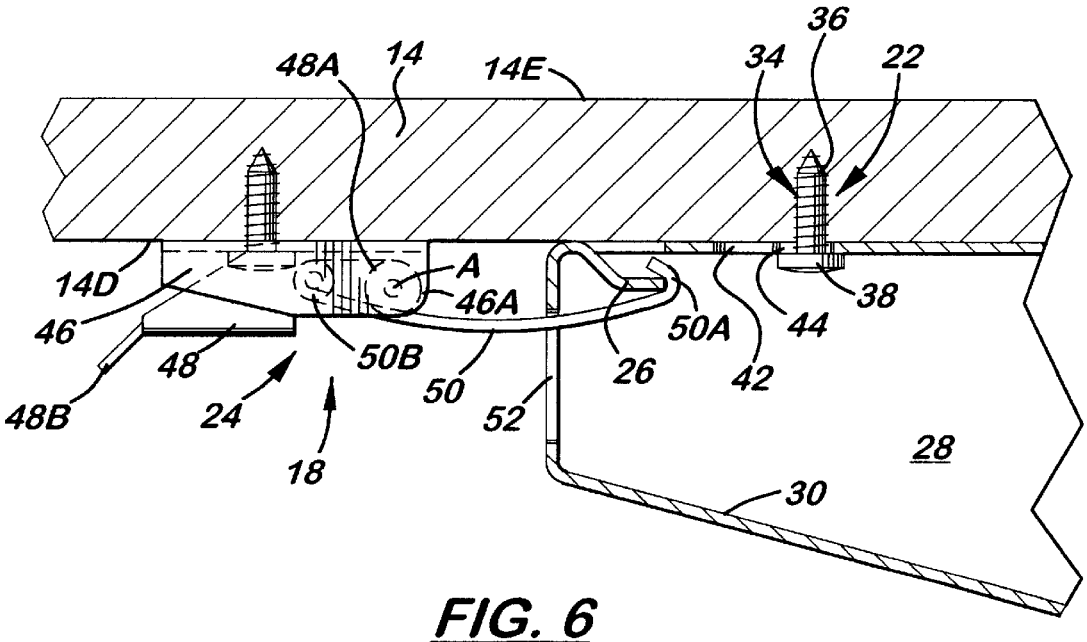
FIG. 6 is a view similar to that of FIG. 5 showing the components of the work surface defining device after being assembled.

Referring to the drawings and particularly to FIGS. 1–3, there is illustrated a removable work surface defining device, generally designated 10, of the present invention. Basically, the work surface defining device 10 includes a pair of rigid support members 12 attachable to a support structure S, such as front edges F of wall portions W of a cabinet or the like, a platform 14 defining a work surface 16 surrounded by spaced apart opposite front and rear edge portions 14A, 14B and spaced apart opposite side edge portions 14C extending between the front and rear edge portions 14A, 14B, and a pair of quick release locking mechanisms 18 each for releasably attaching the platform 14 at a respective one of the opposite side edge portions 14C thereof upon an adjacent respective one of the support members 12. Each quick release locking mechanism 18 includes first and second sets of interengaging elements 20, 22, a locking latch 24, and a catch 26. The first and second sets of interengaging elements 20, 22 of each quick release locking mechanism 18 are disposed on the respective one of the support members 12 and adjacent respective one of the opposite side edge portions 14C of the platform 14. The second set of interengaging elements 22 undergoes movement between released and interengaged positions relative to the first set of interengaging elements 20 with movement of the platform 14 relative to the support members 12 between first and second positions shown respectively in FIGS. 5 and 6. The catches 26 of the respective quick release locking mechanisms 18 are provided on the corresponding support members 12. The locking latches 24 of the respective quick release locking mechanisms 18 are mounted on the respective opposite side edge portions 14C of the platform 14 and movable relative to the platform 14 between disengaged and engaged relationships with the catches 26 on the respective support members 12 to thereby permit and block subsequent movement of the platform 14 between the first and second positions relative to the support members 12 and move the first and second sets of interengaging elements 20, 22 between the released and interengaged positions relative to each other.

Referring to FIGS. 3–6, each of the support members 12 are in the form of a flat panel 28 with a flange 30 attached to and extending substantially continuously about the periphery, and away from one side, of the flat panel 28. Each support member 12 also has an extension plate 32 rigidly mounted thereon and extending rearwardly therefrom so as to define a rear portion 12A of the support member 12 which is attachable at holes 32A in the extension plate 32 in any suitable manner to the support structure S. The continuous flange 30 of each support member 12 provides opposite portions 12B of the support member 12 which extends forwardly from the rear portion 12A thereof. The first set of interengaging elements 20 are provided on the opposite portions 12B of the support member 12 defined by the flange 30.

The platform 14 also has a bottom 14D and a top 14E which defines the work surface 16. The second set of interengaging elements 22 on each of the respective ones of the opposite side edge portions 14C of the platform 14 is a pair of screws 34 having respective threaded stems 36 threadably inserted into the bottom 14D of the platform 14 and respective heads 38 on the threaded stems 36 being spaced from the bottom 14D of the platform 14 and larger in diameter than the threaded stems 36. The first set of interengaging elements 20 on each of the opposite portions 12B of the rigid support members 12 is a pair of keyhole shaped slots 40 defined therein each having a first portion 42 larger in size than the heads 38 of the screws 34 so as to allow insertion of one of the screw heads 38 therethrough and a second portion 44 merging and extending from the first portion 42 and smaller in width than the diameter of the head 38 of the respective screw 34 and larger in width than the diameter of the threaded stem 36 of the screw 34 so as to allow insertion only of the stem 36 of the screw 34 therethrough from the released to interengaged position of the second set of interengaging elements 22 relative to the first set of interengaging elements 20 with movement of the platform 14 from its first to second position.

The quick release locking mechanisms 18 are disposed on the bottom 14D of the platform 14 at the respective opposite side edge portions 14C thereof and on the opposite portions 12B of the respective support members 12 and are adapted to releasably attach the platform 14 at the bottom 14D and respective opposite side edge portions 14C thereof upon one of the opposite portions 12B of each of the respective rigid support members 12. The locking latch 24 of each of the quick release locking mechanisms 18 is disposed in opposite first and second over-centered positions, respectively shown in FIGS. 5 and 6, relative to a pivotal mounting axis A when moved relative to the platform 14 to the respective released and latched relationships with the catch 26. More particularly, the locking latch 24 of each of the quick release locking mechanisms 18 includes a mounting bracket 46, an actuating lever 48, and a latch member 50. The mounting bracket 46 is attached to the bottom 14D of the platform 14 at the respective one of the side edge portions 14C thereof so as to project away from and below the platform 14. The mounting bracket 46 defines the pivotal mounting axis A at one end portion 46A of the mounting bracket 46. The actuating lever 48 is pivotally mounted at one end 48A thereof to the one end portion 46A of the mounting bracket 46 to undergo pivotal movement between the first and second over-centered positions about the pivotal mounting axis A relative to the mounting bracket 46 and the platform 14. The actuating lever 48 has an opposite end 48A for gripping by the installer in order to pivotally move the actuating lever 48. The latch member 50 has a hook-shaped latch element 50A formed at one end thereof adapted for engaging the catch 26. The latch member 50 is pivotally mounted at an opposite end 50B to the actuating lever 48 at a location thereon between and spaced from the ends 48A, 48B thereof such that as the actuating lever 48 is moved between the first and second over-centered positions relative to the mounting bracket 46 the latch member 50 is moved in opposite directions past the pivotal mounting axis A of the actuating lever 48 away from and toward the catch 26 and between the released and latched relationships therewith. The catch 26 of each of the quick release locking mechanisms 18 is a tab formed from and bent outwardly at an acute angle to the respective one of the opposite portions 12B of the respective one of the rigid support members 12.

Figure 4:
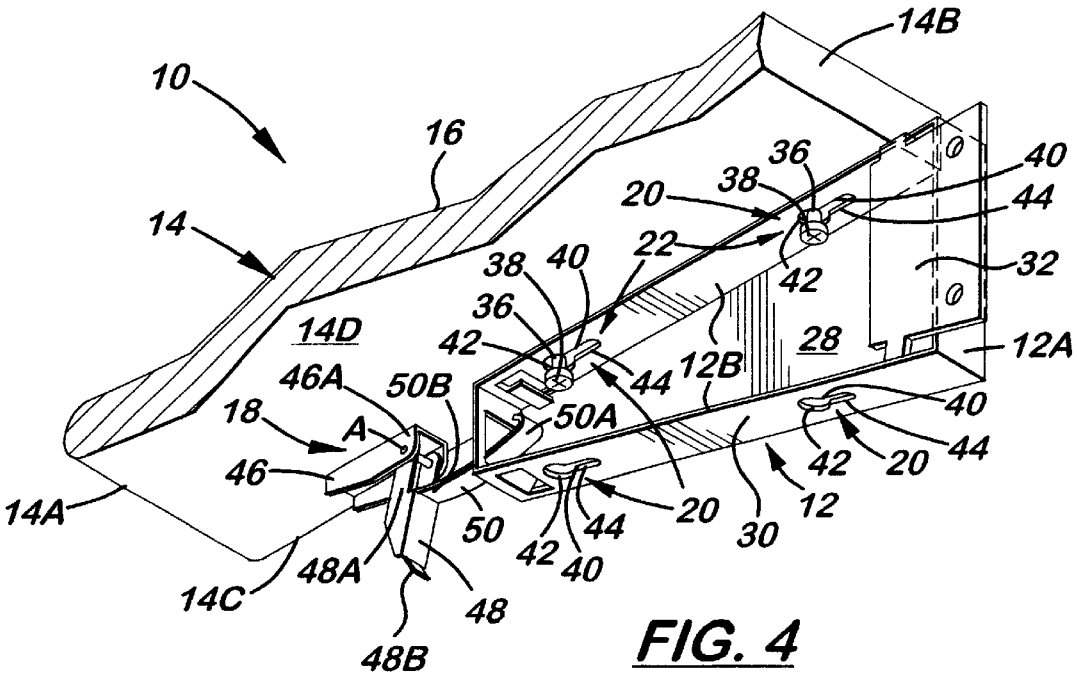
FIG. 4 is a view similar to that of FIG. 3 now showing the components of the work surface defining device in the process of being assembled or disassembled.

To begin assembling of the platform 14 on the support members 12, the heads 38 of the screws 34 on the platform 14 are first aligned with the first portions 42 of the slots 40 in selected ones of the opposite portions 12B of the support members 12 and then the screws 34 are lowered through the slots 40, from the spaced position of FIG. 3 to the engaged or resting position of FIG. 4. Each of the actuating levers 48 of the quick release locking mechanisms 18 is then pivoted counterclockwise as viewed in FIG. 5 to insert the latch member 50 through a square-shaped opening 52 in the end portion of the flange 30 and hook the latch element 50A on the end of the latch member 50 over the catch 26. The platform 14 is then slidably moved from the released position of FIG. 5 to the engaged position of FIG. 6 such that the stems 36 of the screws 34 slide into and along the second portions 44 of the slots 40 and into contact with the ends thereof. The screws 34 are then tightened in place using a suitable screwdriver (not shown). Finally, each of the actuating levers 48 is then pivoted clockwise from the first over-centered position shown in FIG. 5 to the second over-centered position shown in FIG. 6 which locks actuating levers 48 so as to prevent inadvertent reverse movement of the platform 14 relative to the support members 12.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A work surface defining device, comprising:

(a) a pair of rigid support members attachable to a support structure;

(b) a platform defining a work surface surrounded by spaced apart opposite front and rear edge portions and spaced apart opposite side edge portions extending between said front and rear edge portions, said platform being movable between first and second positions relative to said rigid support members; and (c) a pair of quick release locking mechanisms each for releasably attaching said platform at a respective one of said opposite side edge portions thereof upon a corresponding respective one of said rigid support members when said platform has been moved from said first position to said second position relative to said rigid support members, each of said quick release locking mechanisms including (i) a catch provided on said respective one of said rigid support members, and (ii) a locking latch mounted on said respective one of said opposite side edge portions of said platform and pivotally movable about a pivotal mounting axis, defined by said quick release locking mechanism, relative to said platform between a first over-centered position relative to said pivotal mounting axis in which said locking latch is in a released relationship with said catch on said respective one of said rigid support members to thereby permit subsequent movement of said platform from said second position to said first position relative to said support member and a second over-centered position relative to said pivotal mounting axis, being opposite said first over-centered position, in which said locking latch is in a latched relationship with said catch on said respective one of said rigid support members to thereby block subsequent movement of said platform from said second position to said first position relative to said support member.

2. The device of claim 1 wherein each of said quick release locking mechanisms is substantially identical to the other.

3. The device of claim 1 wherein each of said quick release locking mechanisms includes first and second sets of elements disposed on said respective one of said rigid support members and said corresponding respective one of said opposite side edge portions of said platform for undergoing relative movement between released and interengaged positions with one another with movement of said platform between said first position and said second position relative to said rigid support members.

4. The device of claim 1 wherein said catch of each of said quick release locking mechanisms is a tab formed from and bent outwardly at an acute angle to a wall portion of said respective one of said rigid support members.

5. The device of claim 1 wherein said locking latch of each of said quick release locking mechanisms includes:

a mounting bracket attached to said respective one of said side edge portions of said platform and defining said pivotal mounting axis at an end portion of said mounting bracket;

an actuating lever pivotally mounted at one end to said end portion of said mounting bracket for undergoing pivotal movement between said first and second over-centered positions about said pivotal mounting axis relative to said mounting bracket and platform, said actuating lever having an opposite end for gripping in order to pivotally move said actuating lever; and a latch member having a latch element formed at one end adapted for engaging said catch, said latch member being pivotally mounted at an opposite end to said actuating lever at a location thereon between and spaced from said ends of said actuating lever such that as said actuating lever is moved between said first and second over-centered positions relative to said mounting bracket said latch member is moved in opposite directions past said pivotal mounting axis of said actuating lever away from and toward said catch and between said released and latched relationships therewith.

6. The device of claim 5 wherein said catch of each of said quick release locking mechanisms is a tab formed from and bent outwardly at an acute angle to a wall portion of said respective one of said rigid support members.

7. A work surface defining device, comprising:

(a) a pair of rigid support members each having a rear portion attachable to a support structure and an upper portion extending forwardly from said rear portion;

(b) a platform having a bottom and a top spaced above said bottom and defining a work surface surrounded by spaced apart opposite front and rear edge portions and spaced apart opposite side edge portions extending between said front and rear edge portions, said platform being movable between first and second positions relative to said rigid support members; and (c) a pair of quick release locking mechanisms each disposed on said bottom of said platform at one of said respective opposite side edge portions thereof so as to project away from and below said platform and on said upper portion of one of said respective rigid support members and being adapted to releasably attach said platform at said bottom and respective opposite side edge portions thereof upon said upper portions of said respective rigid support members when said platform has been moved from said first position to said second position relative to said rigid support members, said quick release locking mechanisms defining a pivotal mounting axis and respective released and latched relationships of said platform with respect to said rigid support members when said platform is disposed at said second position relative to said rigid support members, said quick release locking mechanisms including locking latches disposed below said platform and movable between opposite first and second over-centered positions relative to said pivotal mounting axis so as to convert said quick release locking mechanisms between said released and latched relationships when said platform is disposed at said second position relative to said rigid support members.

8. The device of claim 7 wherein each of said quick release locking mechanisms is substantially identical to the other.

9. A work surface defining device, comprising:

(a) a pair of rigid support members attachable to a support structure;

(b) a platform defining a work surface surrounded by spaced apart opposite front and rear edge portions and spaced apart opposite side edge portions extending between said front and rear edge portions, said platform being movable between first and second positions relative to said rigid support members; and (c) a pair of quick release locking mechanisms each for releasably attaching said platform at a respective one of said opposite side edge portions thereof upon a corresponding respective one of said rigid support members when said platform has been moved from said first position to said second position relative to said rigid support members, each of said quick release locking mechanisms including (i) first and second sets of interengaging elements on said respective one of said rigid support members and said corresponding respective one of said opposite side edge portions of said platform for undergoing relative movement between released and interengaged positions with one another upon movement of said platform between said first position and said second position relative to said rigid support members;

(ii) a catch provided on said corresponding respective one of said rigid support members, and (iii) a locking latch mounted on said respective one of said opposite side edge portions of said platform and pivotally movable relative to said platform about a pivotal mounting axis, defined by said quick release locking mechanism, between a first over-centered position relative to said pivotal mounting axis in which said locking latch is in a released relationship with said catch on said respective one of said rigid support members to thereby permit subsequent movement of said platform from said second position to said first position relative to said support member and movement therewith of said second set of interengaging elements relative to said first set of interengaging elements from said released position to said interengaged position therewith and a second over-centered position relative to said pivotal mounting axis, being opposite said first over-centered position, in which said locking latch is in a latched relationship with said catch on said respective one of said rigid support members to thereby block subsequent movement of said platform from said second position to said first position relative to said support member and movement therewith of said second set of interengaging elements relative to said first set of interengaging elements from said released position to said interengaged position therewith.

10. The device of claim 9 wherein each of said quick release locking mechanisms is substantially identical to the other.

11. The device of claim 9 wherein said second set of interengaging elements on said respective one of said opposite side edge portions of said platform includes at least a pair of screws having respective threaded stems threadably inserted into said platform and respective heads on said stems being spaced from said platform and larger in diameter than said stems.

12. The device of claim 11 wherein said first set of interengaging elements on said respective one of said rigid support members includes at least a pair of keyhole shaped slots defined therein each having a first portion larger in size than said head of said screw so as to allow insertion of said head of said screw therethrough and a second portion merging and extending from said first portion and smaller in size than said head of said screw and larger in size than said stem of said screw so as to allow insertion only of said stem of said screw therethrough from said released to interengaged position of said second set of interengaging elements relative to said first set of interengaging elements.

13. The device of claim 12 wherein said catch of each of said quick release locking mechanisms is a tab formed from and bent outwardly at an acute angle to a wall portion of said respective one of said rigid support members.

14. The device of claim 9 wherein said locking latch of each of said quick release locking mechanisms includes:

a mounting bracket attached to said respective one of said side edge portions of said platform and defining said pivotal mounting axis at an end portion of said mounting bracket;

an actuating lever pivotally mounted at one end to said end portion of said mounting bracket for undergoing pivotal movement between said first and second over-centered positions about said pivotal mounting axis relative to said mounting bracket and platform, said actuating lever having an opposite end for gripping in order to pivotally move said actuating lever; and a latch member having a latch element formed at one end adapted for engaging said catch, said latch member being pivotally mounted at an opposite end to said actuating lever at a location thereon between and spaced from said ends of said actuating lever such that as said actuating lever is moved between said first and second over-centered positions relative to said mounting bracket said latch member is moved in opposite directions past said pivotal mounting axis of said actuating lever away from and toward said catch and between said released and latched relationships therewith.

15. The device of claim 14 wherein said catch of each of said quick release locking mechanisms is a tab formed from and bent outwardly at an acute angle to a wall portion of said respective one of said rigid support members.

16. The device of claim 9 wherein said catch of each of said quick release locking mechanisms is a tab formed from and bent outwardly at an acute angle to a wall portion of said respective one of said rigid support members.

* * * * *